US007314262B2

(12) United States Patent
Togashi et al.

(10) Patent No.: US 7,314,262 B2
(45) Date of Patent: Jan. 1, 2008

(54) LIQUID EJECTING APPARATUS

(75) Inventors: Takayuki Togashi, Nagano-Ken (JP); Satoru Hosono, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 288 days.

(21) Appl. No.: 11/069,037

(22) Filed: Mar. 2, 2005

(65) Prior Publication Data

US 2005/0219289 A1 Oct. 6, 2005

(30) Foreign Application Priority Data

Mar. 2, 2004 (JP) ..... 2004-057661

(51) Int. Cl.
*B41J 29/393* (2006.01)

(52) U.S. Cl. ..... 347/19; 347/10; 347/11; 347/14

(58) Field of Classification Search ..... 347/19, 347/10, 11, 14
See application file for complete search history.

(56) References Cited

U.S. PATENT DOCUMENTS

2002/0122085 A1* 9/2002 Chaug ..... 347/11
2003/0146165 A1* 8/2003 Katsube et al. ..... 210/695
2005/0088469 A1* 4/2005 Igarashi ..... 347/14
2005/0270318 A1* 12/2005 Noda ..... 347/10

FOREIGN PATENT DOCUMENTS

| | | | |
|---|---|---|---|
| JP | 59-133066 | A | 7/1984 |
| JP | 08-336970 | A | 12/1996 |
| JP | 11-20165 | A | 1/1999 |
| JP | 11-58734 | A | 3/1999 |
| JP | 2003-103840 | A | 4/2003 |

* cited by examiner

*Primary Examiner*—Manish S. Shah
*Assistant Examiner*—Lauren E. Martin
(74) *Attorney, Agent, or Firm*—Sughrue Mion, PLLC

(57) ABSTRACT

A liquid ejecting apparatus of the invention includes a distance obtaining unit that obtains a distance between the nozzle of the head and a medium to which the liquid is ejected. The driving signal is a periodical signal including a first pulse-wave capable of ejecting a drop of the liquid having a predetermined volume at a relatively low speed, and a second pulse-wave capable of ejecting a drop of the liquid having the predetermined volume at a relatively high speed, the predetermined volume corresponding to a predetermined level data. The driving-pulse generator is adapted to generate, when the selected level data is the predetermined level data: a driving-pulse including only the first pulse-wave when a distance obtained by the distance obtaining unit is not less than a predetermined value; and a driving-pulse including only the second pulse-wave when the distance is less than the predetermined value.

10 Claims, 7 Drawing Sheets

LIQUID EJECTING APPARATUS

FIELD OF THE INVENTION

This invention relates to a liquid ejecting apparatus having a head member capable of ejecting drops of liquid from nozzles.

BACKGROUND OF THE INVENTION

In a ink-jetting recording apparatus such as an ink-ejecting printer or an ink-jetting plotter (a kind of liquid ejecting apparatus), a recording head (head member) can move in a main scanning direction, and a recording paper (a kind of medium to which liquid is ejected) can move in a sub-scanning direction perpendicular to the main scanning direction. While the recording head moves in the main scanning direction, a drop of ink can be ejected from a nozzle of the recording head onto the recording paper. Thus, an image including a character or the like can be recorded on the recording paper. For example, the drop of ink can be ejected by causing a pressure chamber communicating with the nozzle to expand and/or contract.

The pressure chamber may be caused to expand and/or contract, for example by utilizing deformation of a piezoelectric vibrating member. In such a recording head, the piezoelectric vibrating member can be deformed based on a supplied driving-pulse in order to change a volume of the pressure chamber. When the volume of the pressure chamber is changed, a pressure of the ink in the pressure chamber may be changed. Then, the drop of ink is ejected from the nozzle.

In such a recording apparatus, a driving signal consisting of a series of a plurality of pulse-waves is generated. On the other hand, printing data including level data (gradation data) can be transmitted to the recording head. Then, based on the transmitted printing data, only necessary one or more pulse-waves are selected from the driving signal and supplied to the piezoelectric vibrating member. Thus, a volume of the ink ejected from the nozzle may be changed based on the level data.

It has been proposed that a plurality of ink drops whose speeds are different are joined to each other before they reach a recording paper, when the plurality of ink drops are ejected from the same nozzle based on a level data (JP Laid-Open Publication No. 8-336970 and JP Laid-Open Publication No. 59-133066). This manner can remarkably inhibit generation of ink mist, compared with a case wherein the plurality of ink drops are joined to each other after they reach the recording paper.

Recently, various pigment inks are available on the market. The pigment inks are superior in environmental resistance (water resistance and/or light resistance). On the other hand, the pigment inks have high viscosity. Thus, ink mist is likely to be generated by satellite ink drops, compared with conventional dye inks whose viscosity is low.

The inventors have found that it is effective to decrease the ejecting speed of an ink drop in order to inhibit mist generation of a pigment ink. When the ejecting speed of an ink drop is decreased, the tendency of dissociation of the ink drop is inhibited, and hence generation of satellite ink drops is inhibited.

However, when the ejecting speed of an ink drop is decreased, the ink drop reaches the recording paper less precisely. That is, regarding the ejecting speed of an ink drop, the tendency of the generation of the satellite ink drops and the precision of reach to the recording paper are contradictory.

SUMMARY OF THE INVENTION

The object of this invention is to provide a liquid ejecting apparatus such as an ink-eject recording apparatus that can always achieve more suitable ink-ejecting control taking into consideration both tendency of generation of satellite drops (mist) and precision of reach to a recording paper.

In order to achieve the object, the invention is a liquid ejecting apparatus comprising: a head member having a nozzle; a pressure-changing unit that can cause pressure of liquid in the nozzle to change in such a manner that the liquid is ejected from the nozzle; a level-data setting unit that can set a selected level data from a plurality of level data, based on an ejecting data; a driving-signal generator that can generate a driving signal; a driving-pulse generator that can generate a driving pulse based on the selected level data and the driving signal; a main controller that can cause the pressure-changing unit to operate, based on the driving pulse; and a distance obtaining unit that can obtain a distance between the nozzle of the head and a medium to which the liquid is ejected; wherein the driving signal is a periodical signal including a first pulse-wave capable of ejecting a drop of the liquid having a predetermined volume from the nozzle at a relatively low speed, and a second pulse-wave capable of ejecting a drop of the liquid having the predetermined volume from the nozzle at a relatively high speed, the predetermined volume corresponding to a predetermined level data; the driving-pulse generator is adapted to generate, based on the driving signal, when the selected level data is the predetermined level data: a driving-pulse including only the first pulse-wave when a distance obtained by the distance obtaining unit is not less than a predetermined value, and a driving-pulse including only the second pulse-wave when the distance obtained by the distance obtaining unit is less than the predetermined value.

According to the above feature, based on the distance obtained by the distance obtaining unit, it is determined whether the first pulse-wave capable of ejecting a drop of the liquid having the predetermined volume at the relatively low speed is used or the second pulse-wave capable of ejecting a drop of the liquid having the predetermined volume at the relatively high speed is used. That is, when the distance is not less than the predetermined value so that it is more possible for mist to generate, the liquid is ejected at the relatively low speed. When the distance is less than the predetermined value so that it is less possible for mist to generate, the liquid is ejected at the relatively high speed, giving priority to the precision of reach to the medium. Thus, a suitable ink-ejecting control is always achieved taking into consideration both the tendency of mist generation and the precision of reach to the medium.

For example, the plurality of level data include a small-dot data, a middle-dot data and a large-dot data; the predetermined level data is the middle-dot data; the drop of the liquid having the predetermined volume is a middle-dot drop of the liquid; the driving signal is a periodical signal including a first pulse-wave capable of ejecting the middle-dot drop of the liquid from the nozzle at a relatively low speed, a small pulse-wave capable of ejecting a small-dot drop of the liquid from the nozzle, and a second pulse-wave capable of ejecting the middle-dot drop of the liquid from the nozzle at a relatively high speed, in that order; the driving-pulse generator is adapted to generate, based on the driving signal: a driving-pulse including only the small pulse-wave when the selected level data is the small-dot data, a driving-pulse including the first pulse-wave and the second pulse-wave when the selected level data is the large-dot data, a driving-pulse including only the first pulse-wave when the selected level data is the middle-dot data and the distance obtained by the distance obtaining unit is not less than the predetermined value, and a driving-pulse including only the second pulse-wave when the selected level data is the middle-dot data and the distance obtained by the distance obtaining unit is less than the predetermined value.

In the case, preferably, when the selected level data is the large-dot data, the middle-dot drop of the liquid ejected from the nozzle at the relatively low speed by the first pulse-wave is adapted to be caught up with by the middle-dot drop of the liquid ejected from the nozzle at the relatively high speed by the second pulse-wave and to join the same. In the case, mist generation may be effectively inhibited.

For example, the driving pulse generator is adapted to generate a rectangular-pulse row corresponding to a period of the driving signal based on the selected level data, and generate an AND signal of the rectangular-pulse row and the driving signal as the driving pulse.

In addition, if the distance between the nozzle of the head member and the medium is adapted to be set depending on a kind of the medium, the distance obtaining unit may obtain the distance between the nozzle of the head member and the medium based on the kind of the medium. In general, if the liquid is a kind of ink and the medium is a recording paper, that is, if the liquid ejecting apparatus is an ink-jetting recording apparatus, the distance between the nozzle and the recording paper (PG) is set to 1.2 mm when the recording paper is a special paper, or 1.7 mm when the recording paper is a normal paper.

The predetermined value is for example about 1.5 mm. In the case, in the ink-jetting recording apparatus as described above, the pulse-wave used for the normal paper and the pulse-wave used for the special paper can be switched.

The predetermined volume is for example about 7 ng. In addition, the relatively low speed is for example about 8 m/s, and the relatively high speed is for example about 10 m/s.

For example, the pressure-changing unit may have a piezoelectric vibrating member. The liquid may be a kind of ink, in particular a kind of pigment ink.

In addition, the invention is a controlling unit for controlling a liquid ejecting apparatus including a head member having a nozzle, and a pressure-changing unit that can cause pressure of liquid in the nozzle to change in such a manner that the liquid is ejected from the nozzle, comprising: a level-data setting unit that can set a selected level data from a plurality of level data, based on an ejecting data; a driving-signal generator that can generate a driving signal; a driving-pulse generator that can generate a driving pulse based on the selected level data and the driving signal; a main controller that can cause the pressure-changing unit to operate, based on the driving pulse; and a distance obtaining unit that can obtain a distance between the nozzle of the head and a medium to which the liquid is ejected; wherein the driving signal is a periodical signal including a first pulse-wave capable of ejecting a drop of the liquid having a predetermined volume from the nozzle at a relatively low speed, and a second pulse-wave capable of ejecting a drop of the liquid having the predetermined volume from the nozzle at a relatively high speed, the predetermined volume corresponding to a predetermined level data, the driving-pulse generator is adapted to generate, based on the driving signal, when the selected level data is the predetermined level data, a driving-pulse including only the first pulse-wave when a distance obtained by the distance obtaining unit is not less than a predetermined value, and a driving-pulse including only the second pulse-wave when the distance obtained by the distance obtaining unit is less than the predetermined value.

A computer system can materialize the controlling unit or any element of the above controlling unit.

This invention includes a storage unit capable of being read by a computer, storing a program for materializing the controlling unit or any element in a computer system.

This invention also includes the program itself for materializing the controlling unit or the element in the computer system.

This invention includes a storage unit capable of being read by a computer, storing a program including a command for controlling a second program executed by a computer system including a computer, the program being executed by the computer system to control the second program to materialize the controlling unit or the element.

This invention also includes the program itself including the command for controlling the second program executed by the computer system including the computer, the program being executed by the computer system to control the second program to materialize the controlling unit or the element.

The storage unit may be not only a substantial object such as a floppy disk or the like, but also a network for transmitting various signals.

BEST MODE FOR CARRYING OUT THE INVENTION

Embodiments of the invention will now be described in more detail with reference to drawings.

Figure 1:
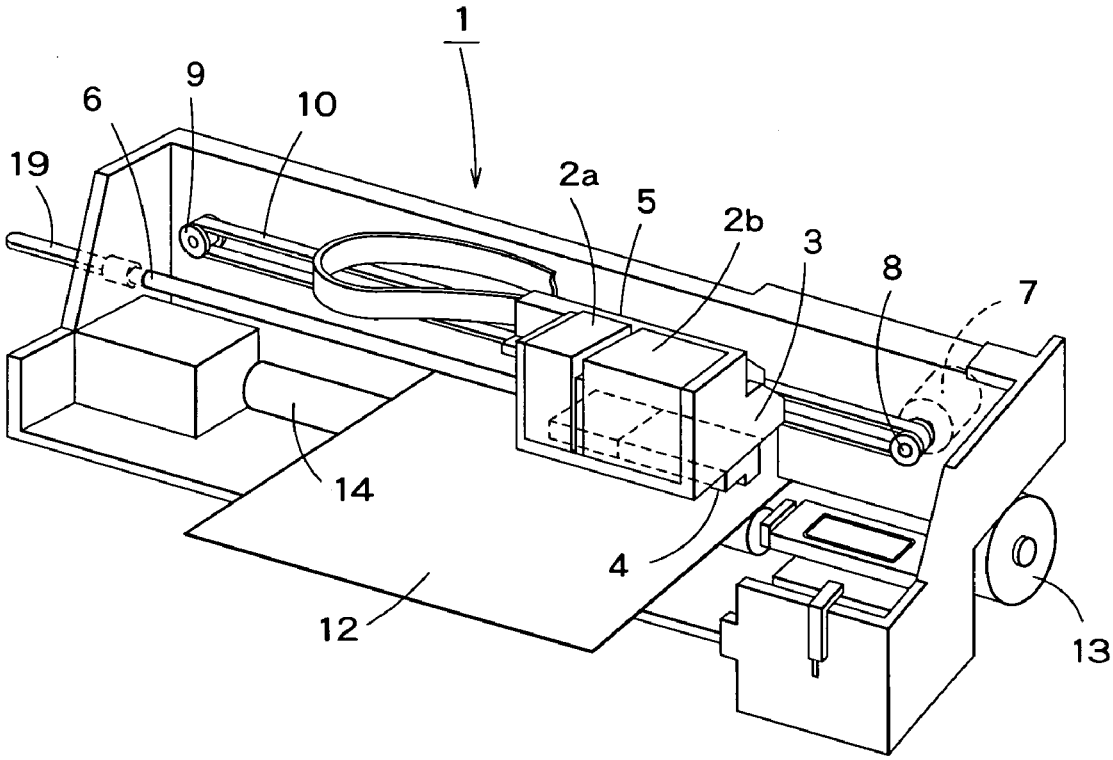
FIG. 1 is a schematic perspective view of an ink-ejecting recording apparatus of an embodiment according to the invention.

FIG. 1 is a schematic perspective view of an ink-jetting printer 1 as a liquid ejecting apparatus of a first embodiment according to the invention. The ink-jetting printer 1 includes a carriage 5, which has a recording head 4 (an example of head member) and a cartridge holder 3 capable of holding a black-ink cartridge 2*a* and a color-ink cartridge 2*b*. The carriage 5 is adapted to be reciprocated in a main scanning direction by a head-scanning mechanism (an example of moving mechanism).

The head-scanning mechanism is formed by: a guide bar 6 horizontally extending in a housing, a pulse motor 7 arranged at a right portion of the housing, a driving pulley 8 connected to a rotational shaft of the pulse motor 7, a free pulley 9 mounted at a left portion of the housing, a timing belt 10 connected to the carriage 5 and going around the driving pulley 8 and the free pulley 9, and a controller 11 (see FIG. 4) for controlling the pulse motor 7. Thus, the carriage 5 i.e. the recording head 4 can be reciprocated in the main scanning direction i.e. in a width direction of a recording paper 12, by driving the pulse motor 7.

A PG adjusting lever 19 is mounted to the guide bar 6. The PG adjusting lever 19 is capable of changing the position of the guide bar 6 in a vertical direction among a plurality of steps. The "PG" means a distance between the nozzle and the recording paper. In the present embodiment, the distance is adapted to be set to 1.7 mm when the recording paper is a normal paper, and 1.2 mm when the recording paper is a special paper. The reason why the "PG" is larger when the recording paper is a normal paper is to secure a margin for the feeding operation.

The printer 1 includes a paper feeding mechanism for feeding the recording paper 12 or any other recording medium (a medium onto which the ink is ejected) in a feeding direction (sub-scanning direction). The paper feeding mechanism consists of a paper feeding motor 13, a paper feeding roller 14 or the like. The recording paper 12, which is an example of a recording medium, is fed in a subordinate scanning direction in turn by the paper feeding mechanism, in cooperation with the recording operation of the recording head 4.

Figure 2:
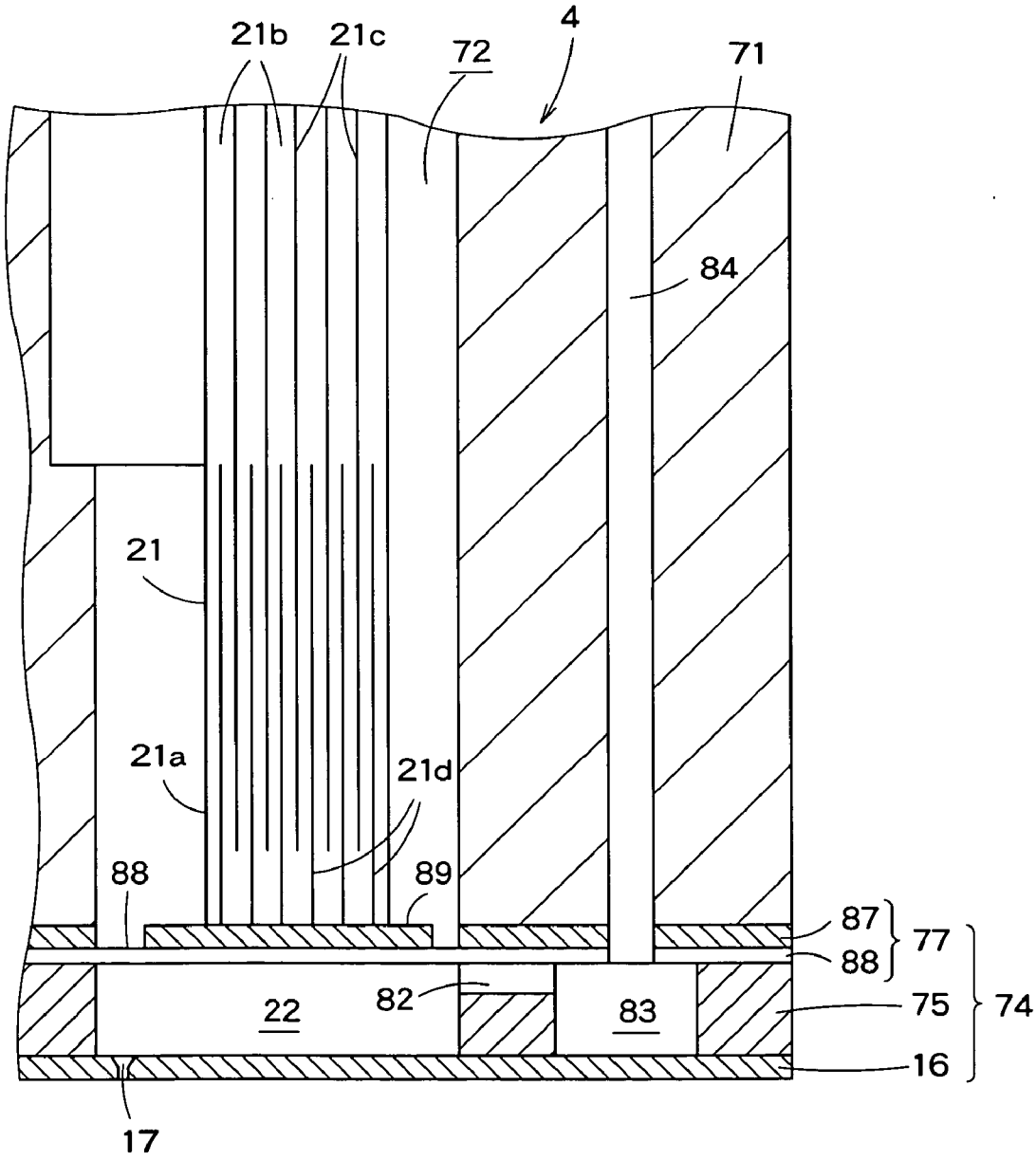
FIG. 2 is a sectional view of an example of a recording head.

Then, the recording head 4 is explained. As shown in FIG. 2, the recording head 4 has a plastic box-like case 71 defining a housing room 72. The longitudinal-mode piezoelectric vibrating unit 21 has a shape of teeth of a comb, and is inserted in the housing room 72 in such a manner that points of teeth-like portions 21*a* of the piezoelectric vibrating unit 21 are aligned at an opening of the housing room 72. A ink-way unit 74 is bonded on a surface of the case 71 on the side of the opening of the housing room 72. The points of the teeth-like portions 21*a* are fixed at predetermined positions of the ink-way unit 74 to function as piezoelectric vibrating members respectively.

The piezoelectric vibrating unit 21 comprises a plurality of piezoelectric layers 21*b*. As shown in FIG. 2, common inside electrodes 21*c* and individual inside electrodes 21*d* are inserted alternately between each adjacent two of the piezoelectric layers 21*b*. The piezoelectric layers 21*b*, the common inside electrodes 21*c* and the individual inside electrodes 21*d* are integrated and cut into the shape of the teeth of the comb. Thus, when a voltage is provided between the common inside electrodes 21*c* and an individual inside electrode 21*d*, a piezoelectric vibrating member contracts in a longitudinal direction of each of the piezoelectric layers 21*b*.

The ink-way unit 74 consists of a nozzle plate 16, an elastic plate 77 and an ink-way forming plate 75 sandwiched between the nozzle plate 16 and the elastic plate 77. The nozzle plate 16, the ink-way forming plate 75 and the elastic plate 77 are integrated as shown in FIG. 2.

A plurality of nozzles 17 is formed in the nozzle plate 16. A plurality of pressure generating chambers 22, a plurality of ink-supplying ways 82 and a common ink-chamber 83 are formed in the ink-way forming plate 75. Each of the pressure chambers 22 is defined by partition walls, and is communicated with a corresponding nozzle 17 at an end portion thereof and with a corresponding ink-supplying way 82 at the other end portion thereof. The common ink-chamber 83 is communicated with all the ink-supplying ways 82, and has a longitudinal shape. For example, the longitudinal common ink-chamber 83 may be formed by an etching process when the ink-way forming plate 75 is a silicon wafer. Then, the pressure chambers 22 are formed in the longitudinal direction of the common ink-chamber 83 at the same intervals (pitches) as nozzles 17. Then, a groove as an ink-supplying way 82 is formed between each of the pressure chambers 22 and the common ink-chamber 83. In the case, the ink-supplying way 82 is connected to an end of the pressure chamber 22, while the nozzle 17 is located near the other end of the pressure chamber 22. The common ink-chamber 83 is adapted to supply ink saved in an ink cartridge to the pressure chambers 22. An ink-supplying tube 84 from the ink cartridge is communicated with a middle portion of the common ink-chamber 83.

The elastic plate 77 is layered on a surface of the ink-way forming plate 75 opposed to the nozzle plate 16. In the case, the elastic plate 77 consists of two laminated layers that are a stainless plate 87 and an elastic high-polymer film 88 such as a PPS film. The stainless plate 87 is provided with island portions 89 for fixing the teeth-like portions 21*a* as the piezoelectric vibrating members 21 in respective portions corresponding to the pressure chambers 22, by an etching process.

In the above recording head 4, a tooth-like portion 21*a* as a piezoelectric vibrating member can expand in the longitudinal direction. Then, an island portion 89 is pressed toward the nozzle plate 16, the elastic film 88 is deformed. Thus, a corresponding pressure chamber 22 contracts. On the other hand, the tooth-like portion 21*a* as the piezoelectric vibrating member can contract from the expanding state in the longitudinal direction. Then, the elastic film 88 is returned to the original state owing to elasticity thereof. Thus, the corresponding pressure chamber 22 expands. By causing the pressure chamber 22 to expand and then causing the pressure chamber 22 to contract, a pressure of the ink in the pressure chamber 22 increases so that the ink drop is ejected from a nozzle 17.

That is, in the above recording head 4, when a tooth-like portion 21*a* as a piezoelectric vibrating member is charged or discharged, the volume of the corresponding pressure chamber 22 is also changed. Thus, by using the change of the volume of the pressure chamber 22, the pressure of the ink in the pressure chamber 22 can be changed, so that a drop of the ink can be ejected from the corresponding nozzle 17 or a meniscus at the corresponding nozzle 17 can be minutely vibrated. The meniscus means a free surface of the ink exposed at an opening of the nozzle 17.

Instead of the above longitudinal-mode piezoelectric vibrating unit 21, bending-mode piezoelectric vibrating members can be used. When a bending-mode piezoelectric vibrating member is used, a charging operation causes a pressure chamber to contract, and a discharging operation causes the pressure chamber to expand.

In the case, the recording head 4 is a many-color-recording head that is capable of recording with a different plurality of colors. Thus, the recording head 4 has a plurality of head units. Respective predetermined colors are set for and used in the plurality of head units, respectively. In the present embodiment, pigment inks are used for the plurality of colors, respectively.

Figure 3:
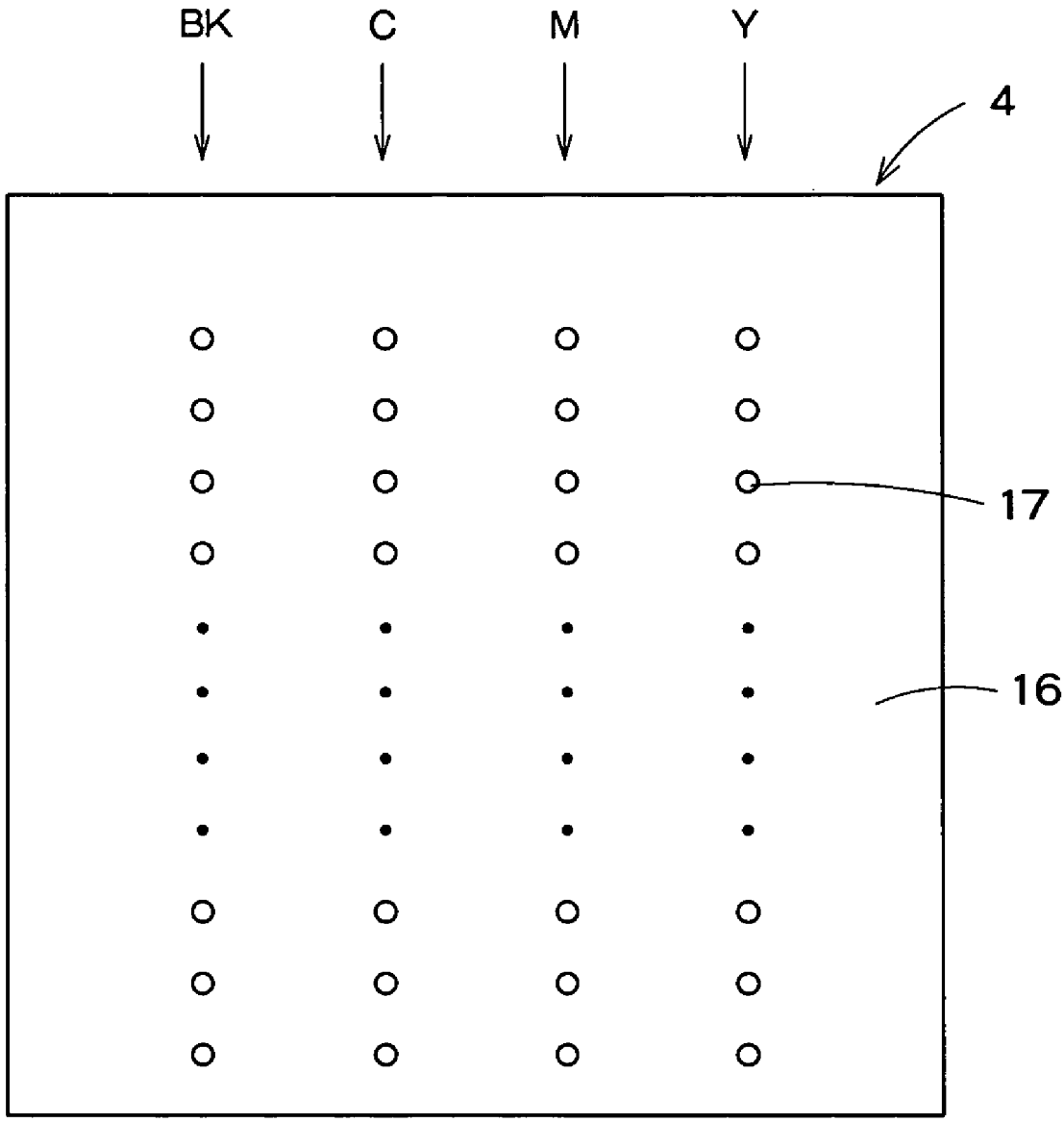
FIG. 3 is a plan view of a nozzle plate including four nozzle rows, each of which corresponds to each color.

In detail, the recording head 4 has: a black head unit capable of ejecting a drop of black ink, a cyan head unit capable of ejecting a drop of cyan ink, a magenta head unit capable of ejecting a drop of magenta ink, and a yellow head unit capable of ejecting a drop of yellow ink. The respective head units are communicated to respective ink chambers in the ink cartridges 2*a* and 2*b*. Each head unit has a structure as explained above with reference to FIG. 2. As shown in FIG. 3, four nozzle rows are formed by the nozzles 17, each nozzle row corresponding to each color (BK, C, M and Y).

Figure 4:
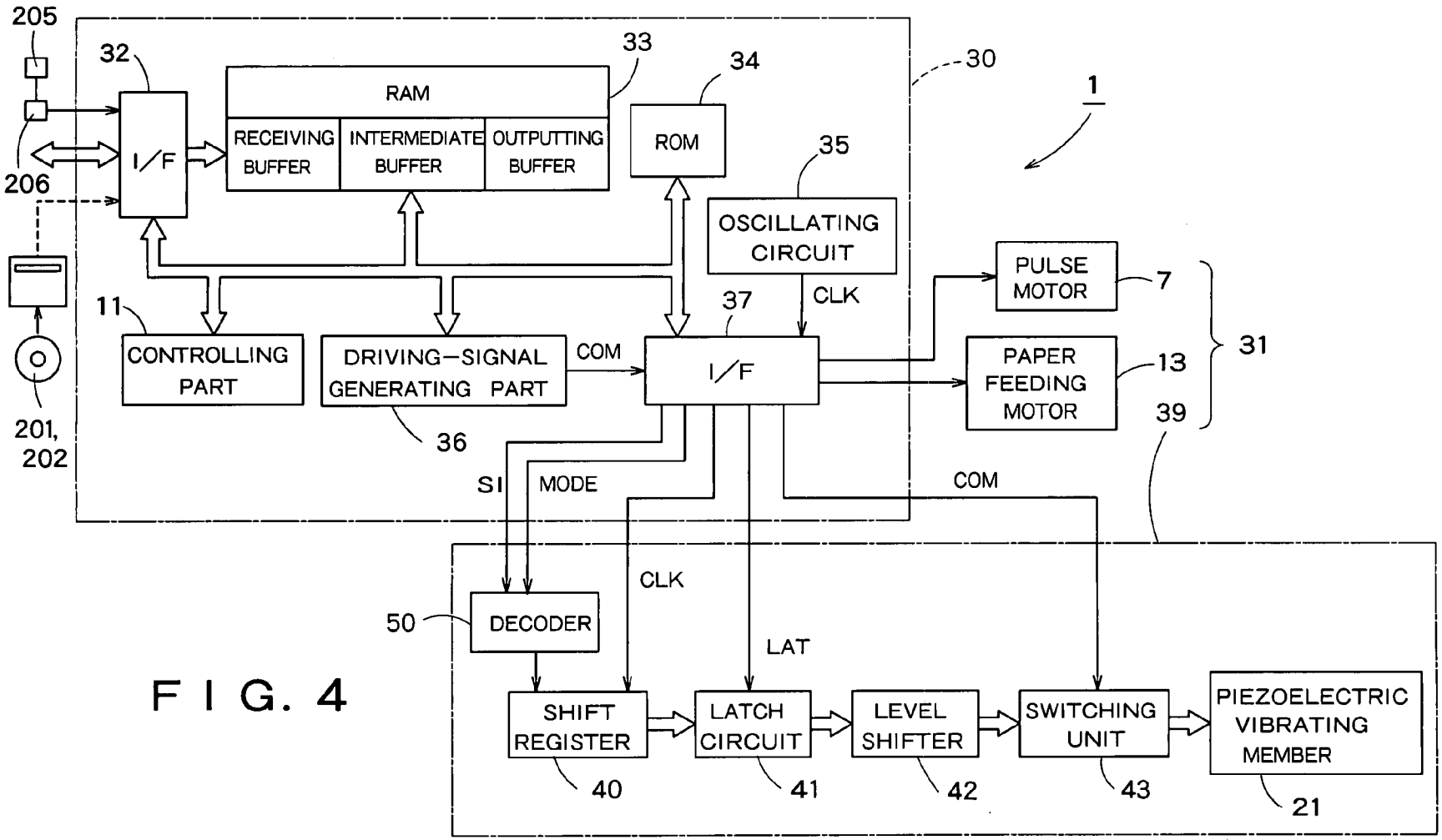
FIG. 4 is a schematic block diagram for explaining an electric structure of the recording head.

Then, an electric structure of the printer 1 is explained. As shown in FIG. 4, the ink-ejecting printer 1 has a printer controller 30 and a printing engine 31.

The printer controller 30 has: an outside interface (outside I/F) 32, a RAM 33 which is able to temporarily store various data, a ROM 34 which stores a controlling program or the like, a controlling part 11 including CPU or the like, an oscillating circuit 35 for generating a clock signal, an driving-signal generating part 36 for generating an driving signal that is supplied into a recording head 4, and an inside interface (inside I/F) 37 that is adapted to send the driving signal, dot-pattern-data (bit-map-data) developed according to printing data (ejecting data) or the like to the print engine 31.

The outside I/F 32 is adapted to receive printing data consisting of character codes, graphic functions, image data or the like from a host computer not shown or the like. In addition, a busy signal (BUSY) or an acknowledge signal (ACK) is adapted to be outputted to the host computer or the like through the outside I/F 32.

The RAM 33 has a receiving buffer, an intermediate buffer, an outputting buffer and a work memory not shown. The receiving buffer is adapted to receive the printing data through the outside I/F 32, and temporarily store the printing data. The intermediate buffer is adapted to store intermediate-code-data converted from the printing data by the controlling part 11. The outputting buffer is adapted to store dot-pattern-data which are data for printing obtained by decoding (translating) the intermediate-code-data (for example, level data).

The ROM 34 stores font data, graphic functions or the like in addition to the controlling program (controlling routine) for carrying out various data-processing operations. The ROM 34 also stores various setting data for maintenance operations.

The controlling part 11 is adapted to carry out various controlling operations according to the controlling program stored in the ROM 34. For example, the controlling part 11 reads out the printing data from the receiving buffer, converts the printing data into the intermediate-code-data, causes the intermediate buffer to store the intermediate-code-data. Then, the controlling part 11 analyzes the intermediate-code-data in the intermediate buffer and develops (decodes) the intermediate-code-data into the dot-pattern-data with reference to the font data and the graphic functions or the like stored in the ROM 34. Then, the controlling part 11 carries out necessary decorating operations to the dot-pattern-data, and thereafter causes the outputting buffer to store the dot-pattern-data.

When the dot-pattern-data corresponding to one line recorded by one main scanning of the recording head 4 are obtained, the dot-pattern-data are outputted to an electric driving system 39 of the recording head 4 from the outputting buffer through the inside I/F 37 in turn. Then, the carriage 5 is moved in the main scanning direction, that is, the recording operation for the one line is conducted. When the dot-pattern-data corresponding to the one line are outputted from the outputting buffer, the intermediate-code-data that has been developed are deleted from the intermediate buffer, and the next developing operation starts for the next intermediate-code-data.

In addition, the controlling part 11 controls a maintenance operation (a recovering operation) conducted before the recording operation by the recording head 4.

The print engine 31 includes a paper feeding motor 13 as a paper feeding mechanism, a pulse motor 7 as a head scanning mechanism, and an electric driving system 39 of the recording head 4.

Then, the electric driving system 39 of the recording head 4 is explained. As shown in FIG. 4, the electric driving system 39 includes decoders 50, shift registers 40, latch circuits 41, level shifters 42 and switching units 43 and the piezoelectric vibrating members 21, which are electrically connected in the order. The decoders 50 correspond to the respective nozzles 17 of the recording head 4, respectively. Similarly, the shift registers 40 correspond to the respective nozzles 17, the latch circuits 41 correspond to the respective nozzles 17, the level shifters 42 correspond to the respective nozzles 17, and the switching units 43 correspond to the respective nozzles 17, respectively. In addition, the piezoelectric vibrating members 21 also correspond to the respective nozzles 17 of the recording head 4, respectively.

In the electric driving system 39, when a pulse-selecting datum (SP datum) supplied to a switching unit 43 is "1", the switching unit 43 is closed (connected) and a pulse-wave in the driving signal is directly supplied to a corresponding piezoelectric vibrating member 21. Thus, the piezoelectric vibrating member 21 deforms according to the pulse-wave of the driving signal. On the other hand, when a pulse-selecting datum (SP datum) supplied to a switching unit 43 is "0", the switching unit 43 is opened (unconnected) and the driving signal is not supplied to a corresponding piezoelectric vibrating member 21.

As described above, based on the pulse-selecting data, the driving signal may be selectively supplied to each piezoelectric vibrating member 21. Thus, dependently on given pulse-selecting data, a drop of the ink may be ejected from a nozzle 17 or a meniscus of ink may be caused to minutely vibrate.

Figure 5:
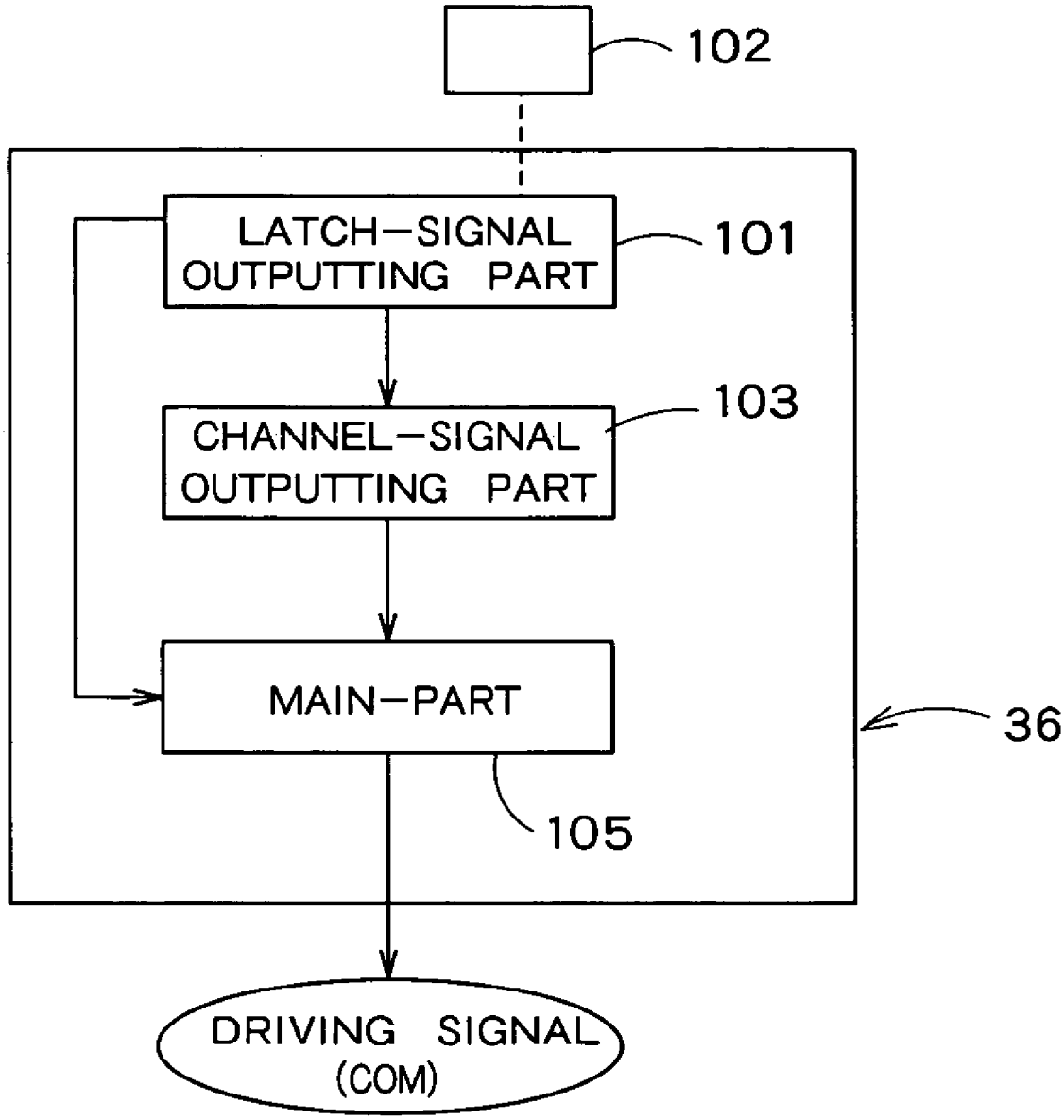
FIG. 5 is a block diagram of a driving-signal generating circuit.

Herein, the driving-signal generating circuit 36 is explained in detail with reference to FIG. 5. As shown in FIG. 5, the driving-signal generating circuit 36 has a latch-signal outputting part 101 that outputs a plurality of latch signals synchronizing with passage timings of predetermined passage positions of the recording head 4. The latch-signal outputting part 101 is connected to an encoder 102 that detects a position or a moving amount of the recording head 4, in order to synchronize with the passage timings of the respective passage positions (corresponding to respective pixels) of the recording head 4.

In addition, the driving-signal generating circuit 36 has a channel-signal outputting part 103, which outputs a first channel signal after a first set time difference and a second channel signal after a second set time difference, subsequent to each latch signal, based on the predetermined time differences against the latch signal.

Then, the latch-signal outputting part 101 and the channel-signal outputting part 103 are connected to a main part 105.

The main-part 105 is adapted to generate a driving signal COM (see FIG. 6) having: a latch pulse-wave appearing at an outputting timing of each latch signal, a first channel pulse-wave appearing at an outputting timing of each first channel signal by the channel-signal outputting part 103, and a second channel pulse-wave appearing at an outputting timing of each second channel signal by the channel-signal outputting part 103, in that order.

Figure 6:
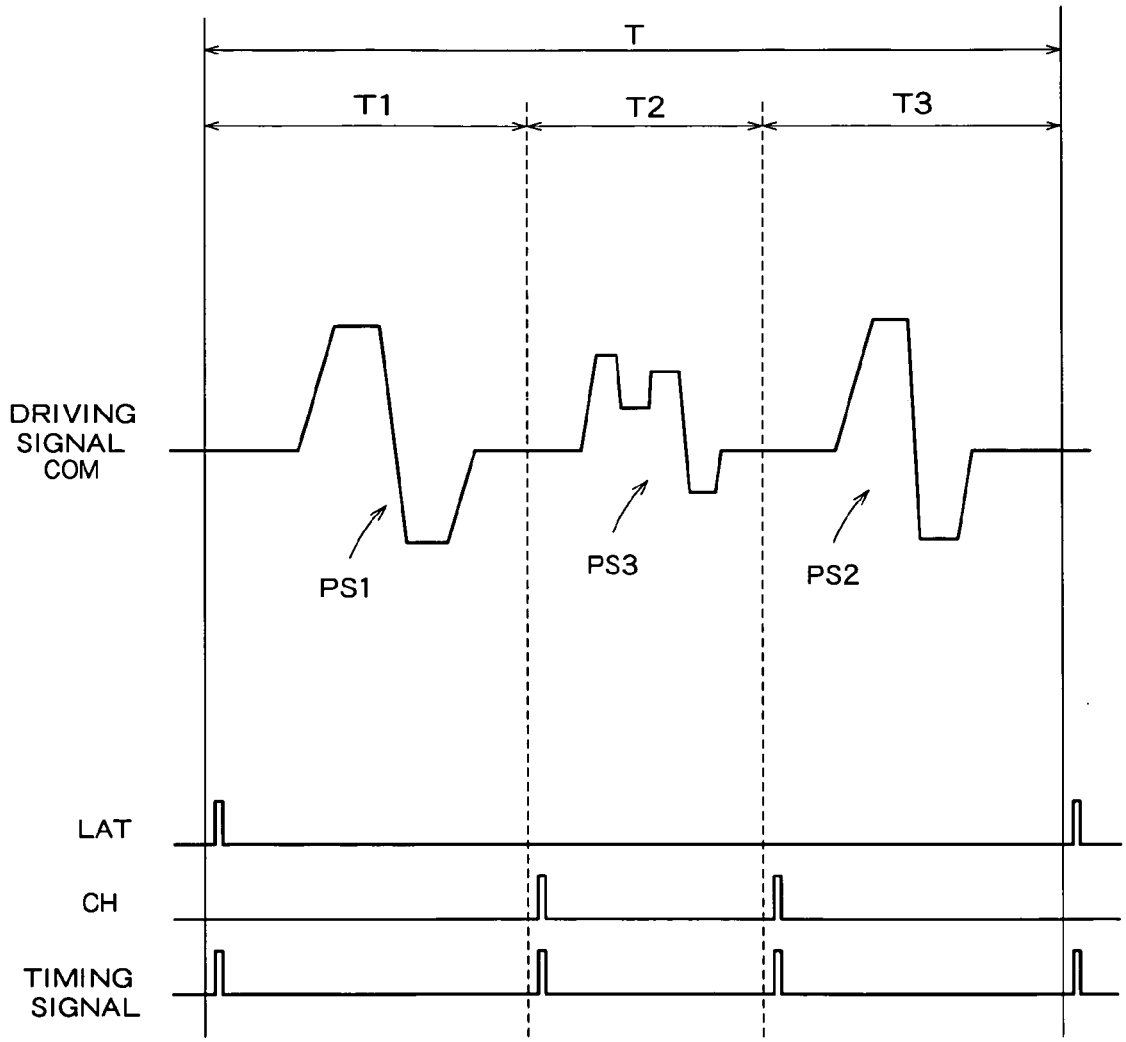
FIG. 6 is a diagram of an example of a driving signal.

As shown in FIG. 6, the driving signal COM is a periodical signal having a recording period T. The recording period T is divided into a part T1 including a first pulse-wave PS1, a part T2 including a small pulse-wave PS3 and a part T3 including a second pulse-wave PS2. The first pulse-wave PS1, the small pulse-wave PS3 and the second pulse-wave PS2 are connected in a series manner.

Each of the first pulse-wave PS1, the small pulse-wave PS3 and the second pulse-wave PS2 can eject a drop of the ink alone.

When the first pulse-wave PS1 is supplied to the piezoelectric vibrating member 21, a drop of the ink, whose volume corresponds to a middle dot, is ejected from the nozzle 17 at a relatively low speed. When the small pulse-wave PS3 is supplied to the piezoelectric vibrating member 21, a drop of the ink, whose volume corresponds to a small dot, is ejected from the nozzle 17. When the second pulse-wave PS2 is supplied to the piezoelectric vibrating member 21, a drop of the ink, whose volume corresponds to a middle dot, is ejected from the nozzle 17 at a relatively high speed.

Figure 7:
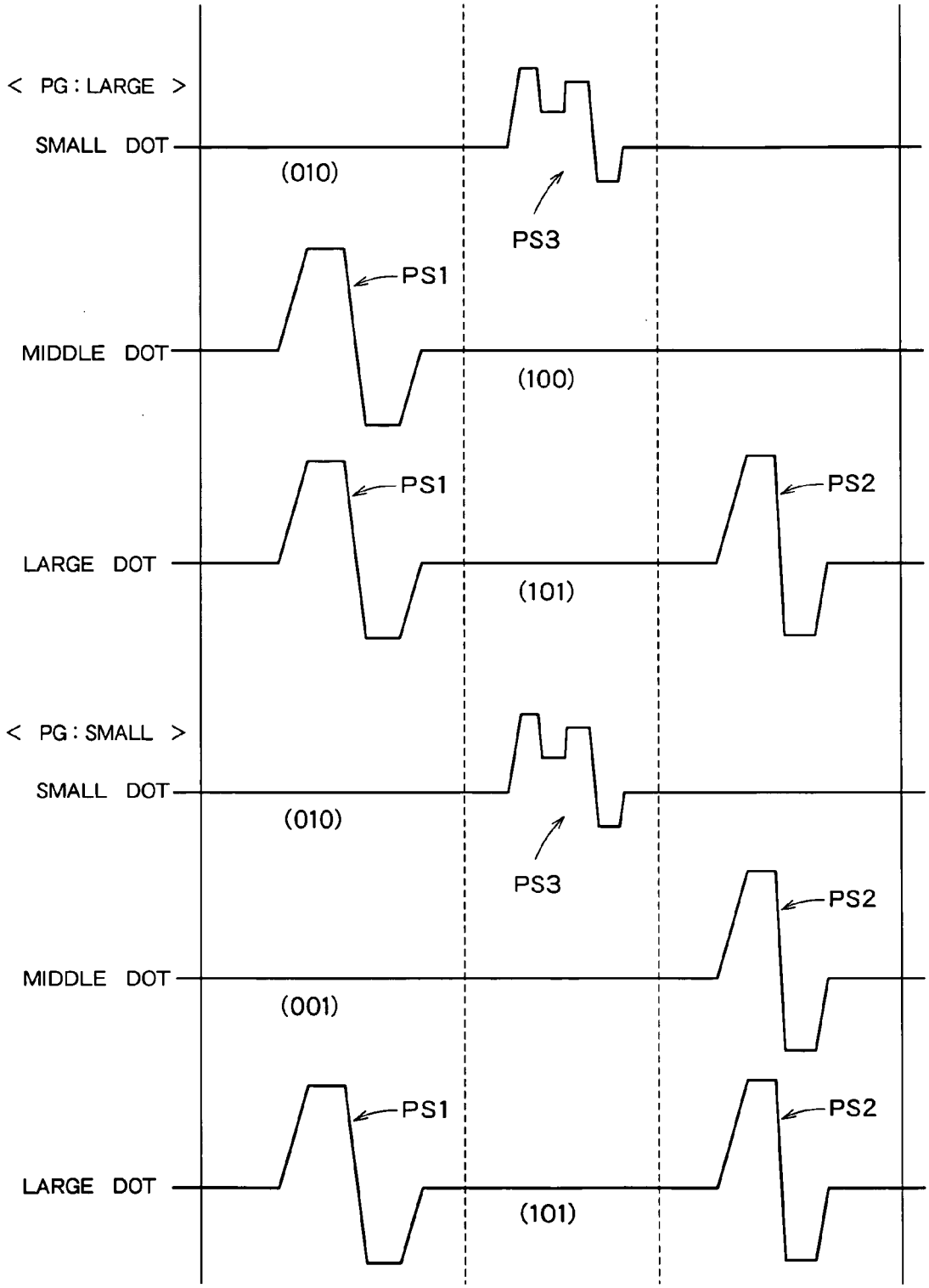
FIG. 7 is a diagram for explaining driving pulses generated based on the driving signal shown in FIG. 6.

As shown in FIG. 7, a level control is conducted by selecting one or more pulse-waves to be supplied to the piezoelectric vibrating member 21. That is, a middle dot is formed on the recording paper 12 by supplying the first pulse-wave PS1 or the second pulse-wave PS2, a small dot is formed on the recording paper 12 by supplying the small pulse-wave PS3, and a large dot is formed on the recording paper 12 by supplying the first pulse-wave PS1 and the second pulse-wave PS2.

Then, pulse-selecting data generated based on non-ejecting dot-pattern data (level data 00), small-dot dot-pattern data (level data 01), middle-dot dot-pattern data (level data 10) and large-dot dot-pattern data (level data 11) are explained in detail.

In the case, the decoder 50 generates pulse-selecting data consisting of three bits, based on the non-ejecting dot-pattern data (level data 00), the small-dot dot-pattern data (level data 01), the middle-dot dot-pattern data (level data 10) and the large-dot dot-pattern data (level data 11), respectively.

As shown in FIG. 7, each of the three bits corresponds to each of the pulse-waves. That is, the first bit of the pulse-selecting data corresponds to the first pulse-wave PS1. The second bit of the pulse-selecting data corresponds to the small pulse-wave PS3. The third bit of the pulse-selecting data corresponds to the second pulse-wave PS2.

In the case, the pulse-selecting data generated based on the non-ejecting dot-pattern data (level data 00) is "000". Similarly, the pulse-selecting data generated based on the small-dot dot-pattern data (level data 01) is "010", and the pulse-selecting data generated based on the large-dot dot-pattern data (level data 11) is "101".

Then, as the feature of the present invention, the pulse-selecting data generated based on the middle-dot dot-pattern data (level data 10) depends on the distance (PG) between the nozzle 17 and the recording paper 12.

Specifically, a distance obtaining unit 206 (see FIG. 4) is adapted to obtain the distance between the nozzle 17 and the recording paper 12. Then, the distance obtaining unit 206 judges whether the distance is less than a predetermined value or not, and sends the result to the decoder 50. In the case, the predetermined value is 1.5 mm.

The decoder 50 generates the pulse-selecting data (100) based on the middle-dot dot-pattern data (level data 10) when the judgment result sent from the distance obtaining unit 206 is not less than the predetermined value (when the recording paper 12 is a normal paper).

On the other hand, the decoder 50 generates the pulse-selecting data (001) based on the middle-dot dot-pattern data (level data 10) when the judgment result sent from the distance obtaining unit 206 is less than the predetermined value (when the recording paper 12 is a special paper).

When the first bit of the pulse-selecting data is "1", the switching circuit 45 (driving-pulse generator) is closed (connected) from a first timing signal (LAT signal), which is generated when the part T1 of the period T starts, to a second timing signal (CH signal), which is generated when the part T2 of the period T starts. In addition, when the second bit of the pulse-selecting data is "1", the switching circuit 45 is closed from the second timing signal to a third timing signal (CH signal), which is generated when the part T3 of the period T starts. Similarly, when the third bit of the pulse-selecting data is "1", the switching circuit 45 is closed from the third timing signal to a timing signal (LAT signal) which is generated when the part T1 of the next period T starts.

Thus, based on the small-dot dot-pattern data, only the small pulse-wave PS3 is supplied to the corresponding piezoelectric vibrating member 21. As a result, correspondingly to the small-dot dot-pattern data, a small-dot drop of the ink is ejected from the nozzle 17. Thus, a small dot is formed on the recording paper 12.

In addition, when the judgment result sent from the distance obtaining unit 206 is not less than the predetermined value, that is, when the "PG" is larger (when the recording paper 12 is a normal paper), based on the middle-dot dot-pattern data, only the first pulse-wave PS1 is supplied to the corresponding piezoelectric vibrating member 21. As a result, correspondingly to the middle-dot dot-pattern data, a middle-dot drop of the ink is ejected from the nozzle 17 at the relatively low speed. Thus, a middle dot is formed on the recording paper 12.

On the other hand, when the judgment result sent from the distance obtaining unit 206 is less than the predetermined value, that is, when the "PG" is smaller (when the recording paper 12 is a special paper), based on the middle-dot dot-pattern data, only the second pulse-wave PS2 is supplied to the corresponding piezoelectric vibrating member 21. As a result, correspondingly to the middle-dot dot-pattern data, a middle-dot drop of the ink is ejected from the nozzle 17 at the relatively high speed. Thus, a middle dot is formed on the recording paper 12.

Then, based on the large-dot dot-pattern data, the first pulse-wave PS1 and the second pulse-wave PS2 are supplied to the corresponding piezoelectric vibrating member 21. As a result, correspondingly to the large-dot dot-pattern data, two middle-dot drops of the ink are ejected from the nozzle 17. Thus, a large dot is formed on the recording paper 12.

As described above, according to the present embodiment, regarding the middle-dot drop of the ink, when the "PG" is not less than the predetermined value and hence it is more possible for mist to be generated, for example when the recording paper 12 is a normal paper, a middle-dot drop of the ink is ejected from the nozzle 17 at the relatively low speed. On the other hand, when the "PG" is less than the predetermined value and hence it is less possible for mist to be generated, for example when the recording paper 12 is a special paper, a middle-dot drop of the ink is ejected from the nozzle 17 at the relatively high speed, giving priority to the precision of reach to the recording paper 12. Thus, a suitable ejecting control of the middle-dot drop of the ink can be achieved taking into consideration balance of the tendency of mist generation and the precision of reach to the recording paper 12.

Specifically, it is preferable that each middle-dot drop of the ink has a volume of about 7 ng, the relatively low speed is about 8 m/s, and the relatively high speed is about 10 m/s. Actually, when the volume of a drop of the ink is about 7 ng and the "PG" is not less than 1.5 mm, if the ejecting speed of the drop of the ink is not larger than 9 m/s, the apparatus is badly befouled with ink mist. However, according to the present embodiment, such befoulment can be avoided. The volume of a small-dot drop of the ink is for example 3 ng.

In the case, preferably, when the selected level data is the large-dot data, the middle-dot drop of the ink ejected from the nozzle 17 at the relatively low speed by the first pulse-wave PS1 is adapted to be caught up with by the middle-dot drop of the ink ejected from the nozzle 17 at the relatively high speed by the second pulse-wave PS2 and to join the same. In the case, mist generation may be remarkably inhibited.

In the above suitable case, that is, if each middle-dot drop of the ink has a volume of about 7 ng, the relatively low speed is about 8 m/s, and the relatively high speed is about 10 m/s, two middle-dot drops of the ink can join to each other in the air, which is preferable.

In addition, the distance obtaining unit 206 may obtain the distance between the nozzle 17 and the recording paper 12 in any known manner. For example, a set position of the PG adjusting lever 19 can be detected. Alternatively, the distance between the nozzle 17 and the recording paper 12 can be actually measured.

If the distance between the nozzle 17 and the recording paper 12 is adapted to be automatically set depending on a kind of the recording paper 12, the distance between the nozzle 17 and the recording paper 12 may be obtained from information of the recording paper 12 inputted from a recording-paper-information inputting part 205. The information of the recording paper 12 may be information about a product-type or the like of the recording paper 12. In the case, the distance obtaining unit 206 has stored table data associating the product-types or the like with respective "PG".

The above embodiment can be variously modified in a scope of claimed invention.

For example, a pressure-generating member for changing the volume of the pressure chamber 22 is not limited to the piezoelectric vibrating member 21. For example, a pressure-generating member can consist of a magnetostrictive device. In the case, the magnetostrictive device causes the pressure chamber 22 to expand and contract, thus, changes the pressure of the ink in the pressure chamber 22. Alternatively, a pressure-generating member can consist of a heating device. In the case, the heating device causes an air bubble in the pressure chamber 22 to expand and contract, thus, changes the pressure of the ink in the pressure chamber 22.

In addition, as described above, the printer controller 30 can be materialized by a computer system. A program for materializing the above one or more components in a computer system, and a storage unit 201 storing the program and capable of being read by a computer, are intended to be protected by this application.

In addition, when the above one or more components may be materialized in a computer system by using a general program such as an OS, a program including a command or commands for controlling the general program, and a storage unit 202 storing the program and capable of being read by a computer, are intended to be protected by this application.

Each of the storage units 201 and 202 can be not only a substantial object such as a floppy disk (flexible disk) or the like, but also a network for transmitting various signals.

The above description is given for the ink-jetting printer as a liquid ejecting apparatus of the embodiment according to the invention. However, this invention is intended to apply to general liquid ejecting apparatuses widely. A liquid may be glue, bonding agent, nail polish, liquid metal for forming an electric circuit, organic liquid or the like, instead of the ink. In addition, this invention can be also applied to an apparatus for manufacturing color filters of a display member such as a liquid crystal display.

What is claimed is:

1. A liquid ejecting apparatus comprising:

a head member having a nozzle, a pressure-changing unit that can cause pressure of liquid in the nozzle to change in such a manner that the liquid is ejected from the nozzle, a level-data setting unit that can set a selected level data from a plurality of level data, based on an ejecting data, a driving-signal generator that can generate a driving signal, a driving-pulse generator that can generate a driving pulse based on the selected level data and the driving signal, a main controller that can cause the pressure-changing unit to operate, based on the driving pulse, and a distance obtaining unit that can obtain a distance between the nozzle of the head and a medium to which the liquid is ejected, wherein the driving signal is a periodical signal including a first pulse-wave capable of ejecting a drop of the liquid having a predetermined volume from the nozzle at a relatively low speed, and a second pulse-wave capable of ejecting a drop of the liquid having the predetermined volume from the nozzle at a relatively high speed, the predetermined volume corresponding to a predetermined level data, the driving-pulse generator is adapted to generate, based on the driving signal, when the selected level data is the predetermined level data:

a driving-pulse including only the first pulse-wave when a distance obtained by the distance obtaining unit is not less than a predetermined value, and a driving-pulse including only the second pulse-wave when the distance obtained by the distance obtaining unit is less than the predetermined value, and wherein:

the plurality of level data include a small-dot data, a middle-dot data and a large-dot data, the predetermined level data is the middle-dot data, the drop of the liquid having the predetermined volume is a middle-dot drop of the liquid, the driving signal is a periodical signal including a first pulse-wave capable of ejecting the middle-dot drop of the liquid from the nozzle at a relatively low speed, a small pulse-wave capable of ejecting a small-dot drop of the liquid from the nozzle, and a second pulse-wave capable of ejecting the middle-dot drop of the liquid from the nozzle at a relatively high speed, in that order, the driving-pulse generator is adapted to generate, based on the driving signal:

a driving-pulse including only the small pulse-wave when the selected level data is the small-dot data, a driving-pulse including the first pulse-wave and the second pulse-wave when the selected level data is the large-dot data, a driving-pulse including only the first pulse-wave when the selected level data is the middle-dot data and the distance obtained by the distance obtaining unit is not less than the predetermined value, and a driving-pulse including only the second pulse-wave when the selected level data is the middle-dot data and the distance obtained by the distance obtaining unit is less than the predetermined value.

2. A liquid ejecting apparatus according to claim 1, wherein:

when the selected level data is the large-dot data, the middle-dot drop of the liquid ejected from the nozzle at the relatively low speed by the first pulse-wave is adapted to be caught up with by the middle-dot drop of the liquid ejected from the nozzle at the relatively high speed by the second pulse-wave and to join the same.

3. A liquid ejecting apparatus according to claim 1, wherein:

the driving pulse generator is adapted to generate a rectangular-pulse row corresponding to a period of the driving signal based on the selected level data, and generate an AND signal of the rectangular-pulse row and the driving signal as the driving pulse.

4. A liquid ejecting apparatus according to claim 1, wherein:

the distance between the nozzle of the head member and the medium is adapted to be set depending on a kind of the medium, and the distance obtaining unit is adapted to obtain the distance between the nozzle of the head member and the medium based on the kind of the medium.

5. A controlling unit for controlling a liquid ejecting apparatus including a head member having a nozzle, and a pressure-changing unit that can cause pressure of liquid in the nozzle to change in such a manner that the liquid is ejected from the nozzle, comprising:

a level-data setting unit that can set a selected level data from a plurality of level data, based on an ejecting data, a driving-signal generator that can generate a driving signal, a driving-pulse generator that can generate a driving pulse based on the selected level data and the driving signal, a main controller that can cause the pressure-changing unit to operate, based on the driving pulse, and a distance obtaining unit that can obtain a distance between the nozzle of the head and a medium to which the liquid is ejected, wherein the driving signal is a periodical signal including a first pulse-wave capable of ejecting a drop of the liquid having a predetermined volume from the nozzle at a relatively low speed, and a second pulse-wave capable of ejecting a drop of the liquid having the predetermined volume from the nozzle at a relatively high speed, the predetermined volume corresponding to a predetermined level data, the driving-pulse generator is adapted to generate, based on the driving signal, when the selected level data is the predetermined level data:

a driving-pulse including only the first pulse-wave when a distance obtained by the distance obtaining unit is not less than a predetermined value, and a driving-pulse including only the second pulse-wave when the distance obtained by the distance obtaining unit is less than the predetermined value, wherein:

the plurality of level data include a small-dot data, a middle-dot data and a large-dot data, the predetermined level data is the middle-dot data, the drop of the liquid having the predetermined volume is a middle-dot drop of the liquid, the driving signal is a periodical signal including a first pulse-wave capable of ejecting the middle-dot drop of the liquid from the nozzle at a relatively low speed, a small pulse-wave capable of ejecting a small-dot drop of the liquid from the nozzle, and a second pulse-wave capable of ejecting the middle-dot drop of the liquid from the nozzle at a relatively high speed, in that order, the driving-pulse generator is adapted to generate, based on the driving signal:

a driving-pulse including only the small pulse-wave when the selected level data is the small-dot data, a driving-pulse including the first pulse-wave and the second pulse-wave when the selected level data is the large-dot data, a driving-pulse including only the first pulse-wave when the selected level data is the middle-dot data and the distance obtained by the distance obtaining unit is not less than the predetermined value, and a driving-pulse including only the second pulse-wave when the selected level data is the middle-dot data and the distance obtained by the distance obtaining unit is less than the predetermined value.

6. A controlling unit according to claim 5, wherein:

when the selected level data is the large-dot data, the middle-dot drop of the liquid ejected from the nozzle at the relatively low speed by the first pulse-wave is adapted to be caught up with by the middle-dot drop of the liquid ejected from the nozzle at the relatively high speed by the second pulse-wave and to join the same.

7. A storage unit capable of being read by a computer, storing a program for materializing a controlling unit for controlling a liquid ejecting apparatus including; a head member having a nozzle; and a pressure-changing unit that can cause pressure of liquid in the nozzle to change in such a manner that the liquid is ejected from the nozzle; comprising:

a level-data setting unit that can set a selected level data from a plurality of level data, based on an ejecting data, a driving-signal generator that can generate a driving signal, a driving-pulse generator that can generate a driving pulse based on the selected level data and the driving signal, a main controller that can cause the pressure-changing unit to operate, based on the driving pulse, and a distance obtaining unit that can obtain a distance between the nozzle of the head and a medium to which the liquid is ejected, wherein the driving signal is a periodical signal including a first pulse-wave capable of ejecting a drop of the liquid having a predetermined volume from the nozzle at a relatively low speed, and a second pulse-wave capable of ejecting a drop of the liquid having the predetermined volume from the nozzle at a relatively high speed, the predetermined volume corresponding to a predetermined level data, the driving-pulse generator is adapted to generate, based on the driving signal, when the selected level data is the predetermined level data:

a driving-pulse including only the first pulse-wave when a distance obtained by the distance obtaining unit is not less than a predetermined value, and a driving-pulse including only the second pulse-wave when the distance obtained by the distance obtaining unit is less than the predetermined value, wherein:

the plurality of level data include a small-dot data, a middle-dot data and a large-dot data, the predetermined level data is the middle-dot data, the drop of the liquid having the predetermined volume is a middle-dot drop of the liquid, the driving signal is a periodical signal including a first pulse-wave capable of ejecting the middle-dot drop of the liquid from the nozzle at a relatively low speed, a small pulse-wave capable of ejecting a small-dot drop of the liquid from the nozzle, and a second pulse-wave capable of ejecting the middle-dot drop of the liquid from the nozzle at a relatively high speed, in that order, the driving-pulse generator is adapted to generate, based on the driving signal:

a driving-pulse including only the small pulse-wave when the selected level data is the small-dot data, a driving-pulse including the first pulse-wave and the second pulse-wave when the selected level data is the large-dot data, a driving-pulse including only the first pulse-wave when the selected level data is the middle-dot data and the distance obtained by the distance obtaining unit is not less than the predetermined value, and a driving-pulse including only the second pulse-wave when the selected level data is the middle-dot data and the distance obtained by the distance obtaining unit is less than the predetermined value.

8. A storage unit capable of being read by a computer, storing a program including a command for controlling a second program executed by a computer system including a computer, the program is executed by the computer system to control the second program to materialize a controlling unit for controlling a liquid ejecting apparatus including; a head member having a nozzle; and a pressure-changing unit that can cause pressure of liquid in the nozzle to change in such a manner that the liquid is ejected from the nozzle; comprising:

a level-data setting unit that can set a selected level data from a plurality of level data, based on an ejecting data, a driving-signal generator that can generate a driving signal, a driving-pulse generator that can generate a driving pulse based on the selected level data and the driving signal, a main controller that can cause the pressure-changing unit to operate, based on the driving pulse, and a distance obtaining unit that can obtain a distance between the nozzle of the head and a medium to which the liquid is ejected, wherein the driving signal is a periodical signal including a first pulse-wave capable of ejecting a drop of the liquid having a predetermined volume from the nozzle at a relatively low speed, and a second pulse-wave capable of ejecting a drop of the liquid having the predetermined volume from the nozzle at a relatively high speed, the predetermined volume corresponding to a predetermined level data, the driving-pulse generator is adapted to generate, based on the driving signal, when the selected level data is the predetermined level data:

a driving-pulse including only the first pulse-wave when a distance obtained by the distance obtaining unit is not less than a predetermined value, and a driving-pulse including only the second pulse-wave when the distance obtained by the distance obtaining unit is less than the predetermined value, wherein:

the plurality of level data include a small-dot data, a middle-dot data and a large-dot data, the predetermined level data is the middle-dot data, the drop of the liquid having the predetermined volume is a middle-dot drop of the liquid, the driving signal is a periodical signal including a first pulse-wave capable of ejecting the middle-dot drop of the liquid from the nozzle at a relatively low speed, a small pulse-wave capable of ejecting a small-dot drop of the liquid from the nozzle, and a second pulse-wave capable of ejecting the middle-dot drop of the liquid from the nozzle at a relatively high speed, in that order, the driving-pulse generator is adapted to generate, based on the driving signal:

a driving-pulse including only the small pulse-wave when the selected level data is the small-dot data, a driving-pulse including the first pulse-wave and the second pulse-wave when the selected level data is the large-dot data, a driving-pulse including only the first pulse-wave when the selected level data is the middle-dot data and the distance obtained by the distance obtaining unit is not less than the predetermined value, and a driving-pulse including only the second pulse-wave when the selected level data is the middle-dot data and the distance obtained by the distance obtaining unit is less than the predetermined value.

9. A program for materializing a controlling unit for controlling a liquid ejecting apparatus including; a head member having a nozzle; and a pressure-changing unit that can cause pressure of liquid in the nozzle to change in such a manner that the liquid is ejected from the nozzle; comprising:

a level-data setting unit that can set a selected level data from a plurality of level data, based on an ejecting data, a driving-signal generator that can generate a driving signal, a driving-pulse generator that can generate a driving pulse based on the selected level data and the driving signal, a main controller that can cause the pressure-changing unit to operate, based on the driving pulse, and a distance obtaining unit that can obtain a distance between the nozzle of the head and a medium to which the liquid is ejected, wherein the driving signal is a periodical signal including a first pulse-wave capable of ejecting a drop of the liquid having a predetermined volume from the nozzle at a relatively low speed, and a second pulse-wave capable of ejecting a drop of the liquid having the predetermined volume from the nozzle at a relatively high speed, the predetermined volume corresponding to a predetermined level data, the driving-pulse generator is adapted to generate, based on the driving signal, when the selected level data is the predetermined level data:

a driving-pulse including only the first pulse-wave when a distance obtained by the distance obtaining unit is not less than a predetermined value, and a driving-pulse including only the second pulse-wave when the distance obtained by the distance obtaining unit is less than the predetermined value, wherein:

the plurality of level data include a small-dot data, a middle-dot data and a large-dot data, the predetermined level data is the middle-dot data, the drop of the liquid having the predetermined volume is a middle-dot drop of the liquid, the driving signal is a periodical signal including a first pulse-wave capable of ejecting the middle-dot drop of the liquid from the nozzle at a relatively low speed, a small pulse-wave capable of ejecting a small-dot drop of the liquid from the nozzle, and a second pulse-wave capable of ejecting the middle-dot drop of the liquid from the nozzle at a relatively high speed, in that order, the driving-pulse generator is adapted to generate, based on the driving signal:

a driving-pulse including only the small pulse-wave when the selected level data is the small-dot data, a driving-pulse including the first pulse-wave and the second pulse-wave when the selected level data is the large-dot data, a driving-pulse including only the first pulse-wave when the selected level data is the middle-dot data and the distance obtained by the distance obtaining unit is not less than the predetermined value, and a driving-pulse including only the second pulse-wave when the selected level data is the middle-dot data and the distance obtained by the distance obtaining unit is less than the predetermined value.

10. A program including a command for controlling a second program executed by a computer system including a computer, the program is executed by the computer system to control the second program to materialize a controlling unit for controlling a liquid ejecting apparatus including; a head member having a nozzle; and a pressure-changing unit that can cause pressure of liquid in the nozzle to change in such a manner that the liquid is ejected from the nozzle; comprising:

a level-data setting unit that can set a selected level data from a plurality of level data, based on an ejecting data, a driving-signal generator that can generate a driving signal, a driving-pulse generator that can generate a driving pulse based on the selected level data and the driving signal, a main controller that can cause the pressure-changing unit to operate, based on the driving pulse, and a distance obtaining unit that can obtain a distance between the nozzle of the head and a medium to which the liquid is ejected, wherein the driving signal is a periodical signal including a first pulse-wave capable of ejecting a drop of the liquid having a predetermined volume from the nozzle at a relatively low speed, and a second pulse-wave capable of ejecting a drop of the liquid having the predetermined volume from the nozzle at a relatively high speed, the predetermined volume corresponding to a predetermined level data, the driving-pulse generator is adapted to generate, based on the driving signal, when the selected level data is the predetermined level data:

a driving-pulse including only the first pulse-wave when a distance obtained by the distance obtaining unit is not less than a predetermined value, and a driving-pulse including only the second pulse-wave when the distance obtained by the distance obtaining unit is less than the predetermined value, wherein:

the plurality of level data include a small-dot data, a middle-dot data and a large-dot data, the predetermined level data is the middle-dot data, the drop of the liquid having the predetermined volume is a middle-dot drop of the liquid, the driving signal is a periodical signal including a first pulse-wave capable of ejecting the middle-dot drop of the liquid from the nozzle at a relatively low speed, a small pulse-wave capable of ejecting a small-dot drop of the liquid from the nozzle, and a second pulse-wave capable of ejecting the middle-dot drop of the liquid from the nozzle at a relatively high speed, in that order, the driving-pulse generator is adapted to generate, based on the driving signal:

a driving-pulse including only the small pulse-wave when the selected level data is the small-dot data, a driving-pulse including the first pulse-wave and the second pulse-wave when the selected level data is the large-dot data, a driving-pulse including only the first pulse-wave when the selected level data is the middle-dot data and the distance obtained by the distance obtaining unit is not less than the predetermined value, and a driving-pulse including only the second pulse-wave when the selected level data is the middle-dot data and the distance obtained by the distance obtaining unit is less than the predetermined value.

* * * * *